US005630608A

United States Patent [19]

Luitz et al.

[11] Patent Number: 5,630,608

[45] Date of Patent: May 20, 1997

[54] SKI BRAKE

[75] Inventors: Max Luitz, Blaichach-Bihlerdorf; Hans Frick, Wiggensbach, both of Germany

[73] Assignee: Atomic Austria GmbH, Altenmarkt im Pongau, Austria

[21] Appl. No.: 379,980

[22] Filed: Jan. 27, 1995

[30] Foreign Application Priority Data

Jan. 28, 1994 [AT] Austria ..... 164/94

[51] Int. Cl.[6] ..... A63C 7/10

[52] U.S. Cl. ..... 280/605

[58] Field of Search ..... 280/604, 605, 280/28.11

[56] References Cited

U.S. PATENT DOCUMENTS

| | | | |
|---|---|---|---|
| 4,262,926 | 4/1981 | Riedel | 280/605 |
| 4,379,570 | 4/1983 | Sedlmair | 280/605 |
| 4,508,360 | 4/1985 | Beyl et al. | 280/605 |
| 4,564,211 | 1/1986 | Luitz et al. | 280/605 |
| 4,708,360 | 11/1987 | Peyre | 280/605 |
| 4,759,565 | 7/1988 | Arduin et al. | 280/605 |
| 4,856,806 | 8/1989 | Arduin | 280/605 |
| 4,973,072 | 11/1990 | Stritzl et al. | 280/605 |
| 5,033,766 | 7/1991 | Sedlmair et al. | 280/605 |
| 5,092,619 | 3/1992 | Leichtfried et al. | 280/605 |

FOREIGN PATENT DOCUMENTS

| | | |
|---|---|---|
| 0077006 | 7/1985 | European Pat. Off. . |
| 2 586 578 | 3/1987 | France . |
| 2 607 712 | 6/1988 | France . |
| 27 26 023 | 3/1978 | Germany . |
| 621 709 | 2/1981 | Switzerland . |
| 644 025 | 7/1984 | Switzerland . |

*Primary Examiner*—Brian L. Johnson
*Attorney, Agent, or Firm*—Collard & Roe, P.C.

[57] ABSTRACT

A ski brake comprises a symmetrically arranged bearing device comprising a housing on each side of the central ski axis, the housing defining a first bore extending parallel to the central axis, and a bearing bore extending perpendicularly to the central axis. A brake lever is rotatably mounted in the bearing bore, a crank arm extending from one end of the brake lever above the upper ski surface and a brake arm extending from an opposite end at an angle thereto, rotation of the brake lever causing the brake arm to be pivoted from a rest position above the upper surface to a braking position therebelow. A spring is arranged in the first bore for applying an adjusting force to the brake lever to pivot the brake arm into the braking position, an adjustment element is provided having a portion extending into the first bore and having a flange at an end thereof, the spring being arranged between the flange and an end wall of the housing, and a pivot pin extending outside the housing perpendicularly to, and towards, the central axis. A foot pedal is arranged between the adjustment element and the crank arm for transmitting the adjusting force, and the ski brake comprises a damping device exerting a damping force in a direction opposite to the adjusting force of the spring and having a length which is variable along an adjustment path from a rest position in the direction of the damping force, the minimal damping force in the rest position being at least equal to the adjusting force in the braking position of the brake arm.

21 Claims, 6 Drawing Sheets

1
2
3
4
5
6
7
8
9
10
11
12
13
14
15
16
17
18
18
19
20
21
22

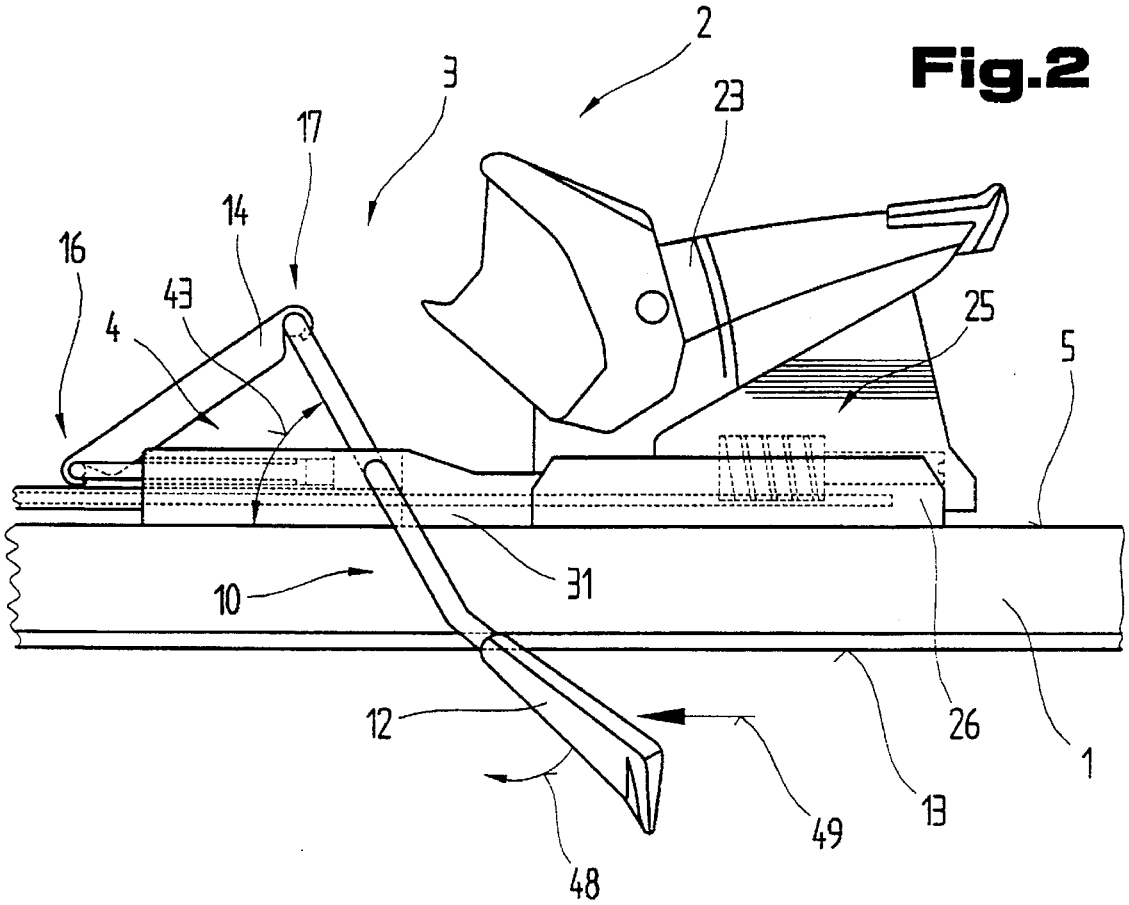
Fig.2
Fig.3
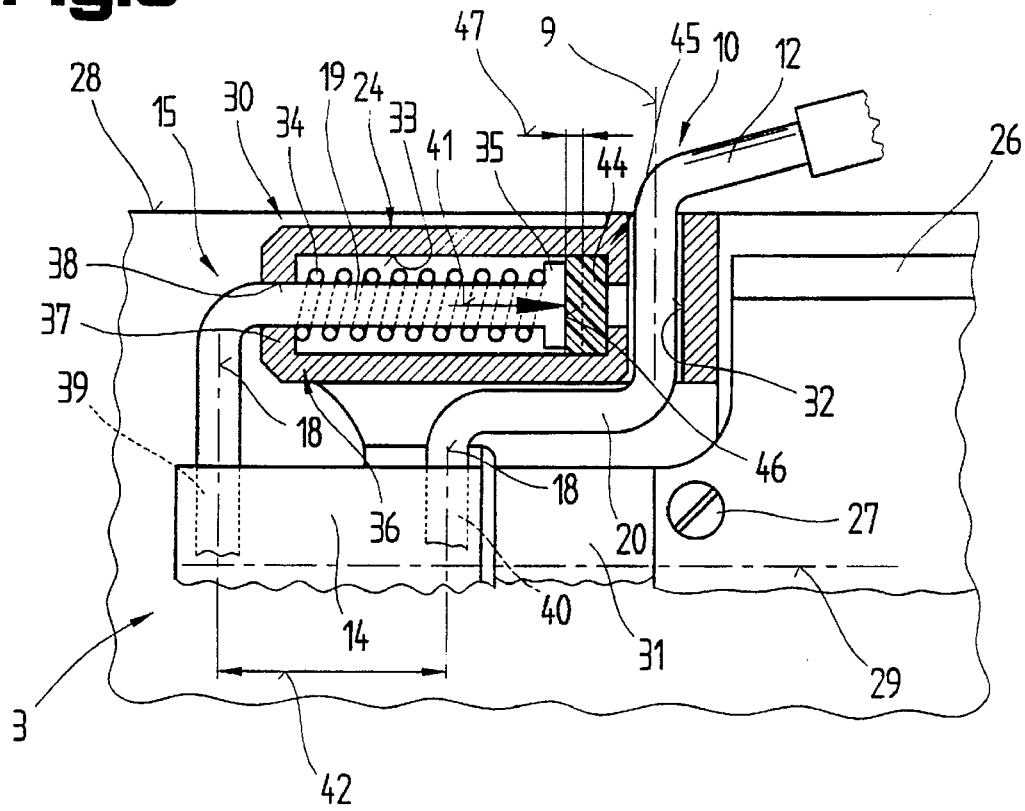

SKI BRAKE

BACKGROUND OF THE INVENTION

1. Field of the Invention

The invention relates to a brake gear for an elongated piece of sports apparatus, in particular a ski, comprising a brake lever pivotable from a rest into a braking position about a pivot preceding the brake level in a direction of forward movement of the elongated piece of sports apparatus.

2. The Prior Art

A known brake gear—according to U.S. Pat. No. 4,564,211—comprises an adjusting element which extends in the longitudinal direction of the ski and is adjustable by a spring arrangement, and which is linked by a foot pedal to crank arms of two brake levers, each brake lever being arranged for pivoting about a bearing extending in a housing parallel to an upper surface and perpendicular to the longitudinal direction of the ski. In a rest position, the brake levers are positioned at the upper surface of the ski and in a braking position, the brake arms of the brake lever project beyond the running of the ski. The adjusting element, the foot pedal and the brake levers form a relatively rigid system so that, if a force acts in a direction of the pivoting movement of the brake lever, this leads to a partial or total destruction of the movable parts or the housing in the region of the bearing of the brake levers.

SUMMARY OF THE INVENTION

It is an object of the invention to create a brake gear which cannot be damaged even during abrupt stresses on the brake levers in the pivoting direction of the latter without impairing the effect of the brakes.

This object of the invention is achieved with a brake gear for an elongated sports apparatus having an upper surface, a running surface and a central axis extending in a longitudinal direction, which comprises a bearing device arranged symmetrically with respect to the central axis, the bearing device comprising a housing mounted on the upper surface on each side of the central axis, the housing defining a first bore extending parallel to the upper surface and the central axis, and a bearing bore extending parallel to the upper surface and perpendicularly to the central axis. A brake lever having a portion is rotatably mounted in the bearing bore, a crank arm extending from one end of the brake lever portion above the upper surface and a brake arm extending from an opposite end of the brake lever portion at an angle thereto, rotation of the brake lever portion in the bearing bore causing the brake arm to be pivoted from a rest position above the upper surface to a braking position therebelow. A spring force storage device is arranged in the first bore for applying an adjusting force on the brake lever to pivot the brake arm into the braking position, an adjustment element is provided having a portion extending into the first bore and having a flange at an end thereof, the spring force storage device being arranged between the flange and an end wall of the housing, and a pivot pin extending outside the housing perpendicularly to, and towards, the central axis. A foot pedal is arranged between the adjustment element and the crank arm for transmitting the adjusting force, and the brake gear comprises a damping device exerting a damping force in a direction opposite to the adjusting force of the spring force storage device and having a length which is variable along an adjustment path from a rest position in the direction of the damping force, the minimal damping force in the rest position being at least equal to the adjusting force in the braking position of the brake arm.

The surprising advantage of this solution lies in that the arrangement of a damping device in the adjustment path of the brake lever actuation creates a damping force producing an elastic absorption of impact stresses which act upon the brake arm of the brake lever in the pivoting direction in which the brake levers are moved beyond the running surface of the piece of sports apparatus, for example a ski, snowboard or monoski, into the braking position. This way, damage or destruction of components of the brake gear is effectively prevented. In addition, the braking effect of such an improved brake gear is increased in a surprising manner since the piece of sports apparatus cannot as easily be lifted up or overturned when an impact acts upon the brake arms because it is damped and because the brake arms therefore remain engaged for a longer period of time and the tilting moment which is exerted on the piece of sports apparatus is reduced.

If the damping force increases linearly along the adjustment path, a very soft damping characteristic can be achieved. If it increases exponentially, higher stresses are reduced in an effective manner, thus avoiding damages.

If a stationary abutment element delimits the adjustment path, a reliable braking effect is also achieved when the piece of sports apparatus moves in a direction opposite the forward direction of movement.

If the foot pedal is comprised of two telescoping parts and a damping element interconnects the two parts, the damping device can be easily monitored and, should the occasion arise, maintenance work can be carried out in a simple manner.

The length of the bearing device in the region of the adjusting elements can be reduced and the foot pedal can be associated with the heels of the ski boot if bearing arrangements link opposite ends of the foot pedal respectively to the adjusting element and the brake lever for pivoting about parallel axes, an elongation area extending between the opposite foot pedal ends.

Advantageously, the elongation area is defined by weakened portions of the foot pedal extending transversely to the damping force because strong damping of impact stresses can thereby be achieved without the need of additional accessories which would increase assembly and manufacturing costs.

Great reliability of the device is achieved since all mechanically acting components are eliminated if the weakened portions are defined by preferably staggered slot-shaped depressions on upper and lower sides of the foot pedal. If these depressions have side faces adjacent each other at the upper and lower sides, a problem-free transmission of the pressure load of the spring force storage device in the direction of the brake arms and thereby a reliable actuation of the brake force in the pivoted ready-to-brake position of the brake lever is achieved.

An end limitation for a change in length of the foot pedal is achieved so that the stress limits are not exceeded which, when exceeded, would lead to a break of the foot pedal if the bearing device comprises an abutment for the crank arm of the brake lever for delimiting the pivoting path of the brake lever. A sufficient adjustment path is achieved to absorb sudden increases of stress and to avoid damages of the elements of the brake gear if the abutment and the crank arm enclose an angle of 5° in the braking position.

The arrangement of the damping device independently of the kind of stress, for example a tensile force or pressure force if the damping device is comprised of an elastically restorable plastic or rubber having a deformation force which is higher in the damping force direction than in the adjusting force direction.

BRIEF DESCRIPTION OF THE DRAWINGS

For a better understanding of the invention, it will be described hereinafter, by way of example only, in connection with preferred embodiments illustrated in the accompanying drawings, in which:

FIG. 2 is a like view of the brake gear, with a damping device;

FIG. 3 is a top view, partly in section, of the brake gear of FIG. 2;

DETAILED DESCRIPTION OF PREFERRED EMBODIMENTS

Figure 1:
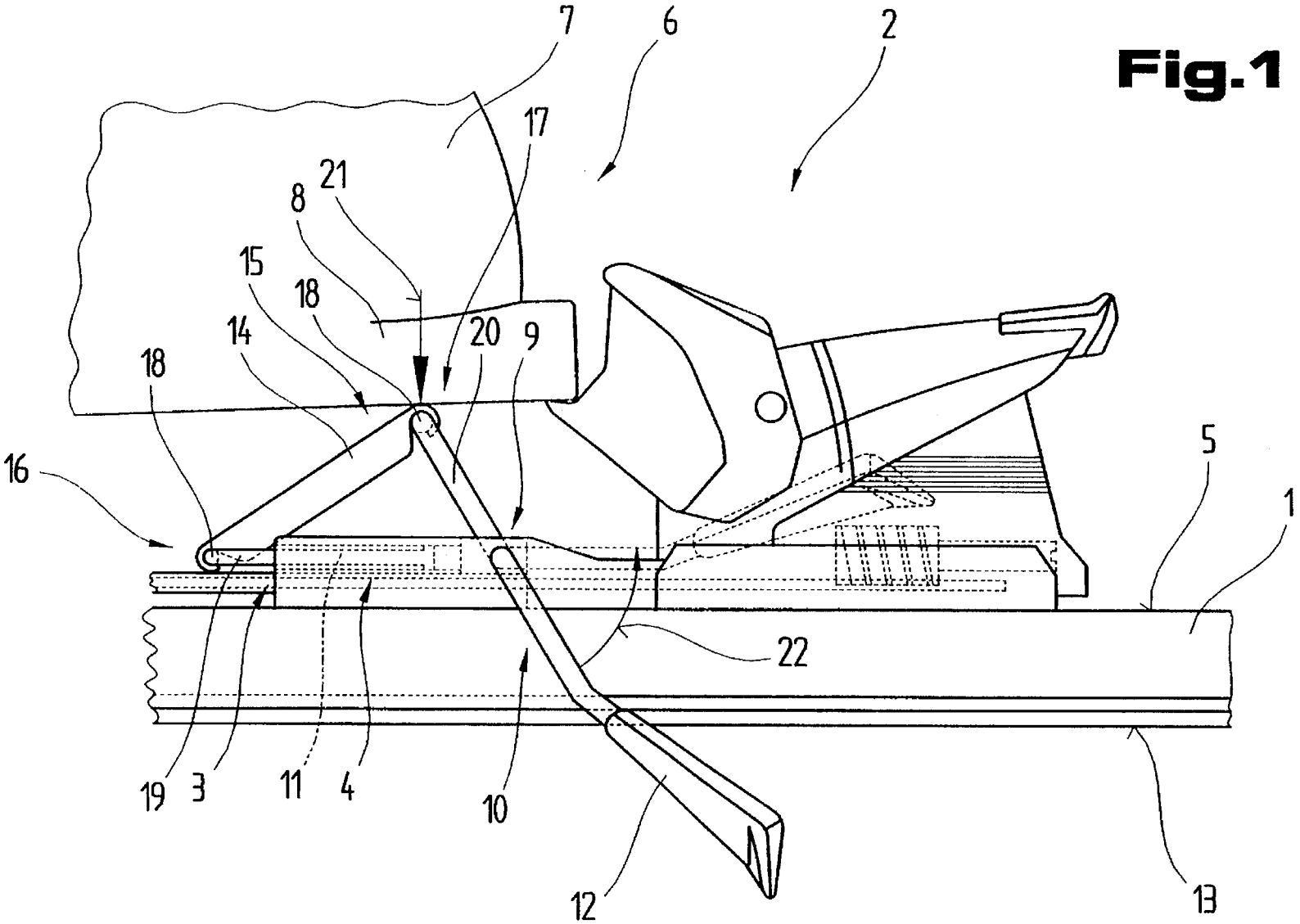
FIG. 1 is a side view of a ski with the brake gear in accordance with the invention when the brake lever is in a position of braking.

FIG. 1 shows a portion of a piece of sports apparatus such as a ski 1, a snowboard, a monoski or the like, with a coupling part 2, for example a heel clamp, and a brake gear 3 arranged on the ski 1. The brake gear 3 is arranged in a bearing device 4 on a surface 5 of the ski 1, as illustrated, for example, immediately adjacent heel 6 of a boot 7. As long as the boot 7 and its sole 8 are out of engagement with coupling part 2, a brake lever 10, which is pivotal about an axis 9 running in the baring device 4 approximately parallel to surface 5 and perpendicularly to a longitudinal extension of the ski 1, is actuated by an energy storage device 11 into its working position, in which a brake arm 12 protrudes from running surface 13 of the ski 1. A foot pedal 14 of the brake gear 3 forms a thrust crank 15 which is directly actuated by the sole 8 which, by means of bearing arrangements 16, 17 forming swivelling axes 18 running parallel to the surface 5 and perpendicularly to the longitudinal direction of the ski 1, are linked to an adjustment element 19 of the energy storage device 11 and a crank arm 20 of the brake lever 10.

If the boot 7 is secured to the ski 1 by the coupling part 2 while a force is exerted upon foot pedal 14 in the direction of arrow 21, brake lever 10 is pivoted in the direction of arrow 22 against the effect of the energy storage device 11 into a rest position in which the brake arm 12—as shown in phantom lines—is located in the region of the surface 5 and preferably within the side edges of the piece of sports apparatus.

FIGS. 2 and 3 show the brake gear 3 arranged in the region of the coupling part 2, for example a heel clamp 23, with the bearing device 4 on the surface 5 of the ski 1. The bearing device 4 is formed by a housing 24 which may be secured to the surface 5 by fastening means 27 together with a C-shaped profile 26 forming a longitudinal guidance 25 for the heel clamp 23. Extending along the side faces 28 of the ski 1 approximately parallel to a longitudinal central axis 29 are receiving chambers 30, which are connected by a flat connecting web 31 running transversely to the longitudinal extension of the ski and connected with the bearing device 4, and fastening means 27 pass through web 31. Because of the symmetrical arrangement of the brake gear 3 with respect to the longitudinal central axis 29 of the ski 1, only one side thereof is described hereinafter.

The receiving chamber 30 forms together with a bore 32 a bearing for the axis 9 of the brake lever 10 which runs approximately parallel to the surface 5 and perpendicularly to the longitudinal central axis 29. Bore 33 in receiving chamber 30 runs parallel to the longitudinal central axis 29 and forms a guiding arrangement for the adjusting element 19 which is surrounded in bore 33 by an energy storage device, for example a spiral compression spring 34, which in its end section facing towards the axis 9 bears on a flange 35 which is connected with the adjusting element 19 for movement therewith. A thrust bearing 36 for the spiral compression spring 34 is constituted by end wall 37 which is arranged opposite to bore 32 for the axis 9 in the receiving chamber 30, and wall 37 has a bore 38 through which the adjusting element 19 passes in a direction running parallel to the longitudinal central axis 29.

The adjusting element 19 and the brake arm 12 with its crank arm 20 have parallel shanks which extend perpendicularly to the longitudinal central axis 29 and constitute pivot pins 39, 40 linked to foot pedal 14 in the bearing arrangements 16, 17.

The brake lever 10 is now kept in its working position in which it extends beyond the running surface 13 by the force exerted upon the adjusting element 19 according to arrow 41. By this force, the adjusting element 19 is pressed towards the axis 9 of the brake lever 10 and due to a predetermined distance 42 between the bearing arrangements 16, 17 of the foot pedal 14, the brake lever 10 remains by means of the crank arm 20 in its working position in which the foot pedal 14 and the crank arm 20 enclose an angle of approximately 90°, thereby creating an angle 43 of about 50° between the crank arm 20 and the surface 5.

In this position, an abutment element 44 of a damping device 45 arranged in the receiving chamber 30 counteracts the spring force of the spiral compression spring 34 on an end face 46 of the flange 35 facing away from the spiral compression spring 34. This abutment element 44 is preferably formed by an elastically deformable spring element, for example a spiral compression spring, a pressure element of an elastomeric material, as shown, or the like.

By this arrangement, depending on the elasticity of the damping device 45, an adjustment path 47 is provided for the adjusting element 19 and, consequently, the brake arm 12—according to arrow 48—is pivoted in the direction of adjustment to assume the braking position, which is advantageous when a force according to arrow 49 acts upon the brake arm 12, to prevent excessive stress of the brake components and thus a break.

This provides a protection against excessive stress of the brake gear 3, in particular of the bearing device 4 and the housing 24 against an impact stress, which occurs if the ski 1 collides with the brake arms 12 with an obstacle in a direction opposite the direction of movement. Such impact stresses are thereby absorbed by the elastic deformability of the damping device 45, which prevents in an effective manner any destruction of the brake lever 10, the housing 24 and also the entire mechanism of the brake gear 3.

Figure 4:
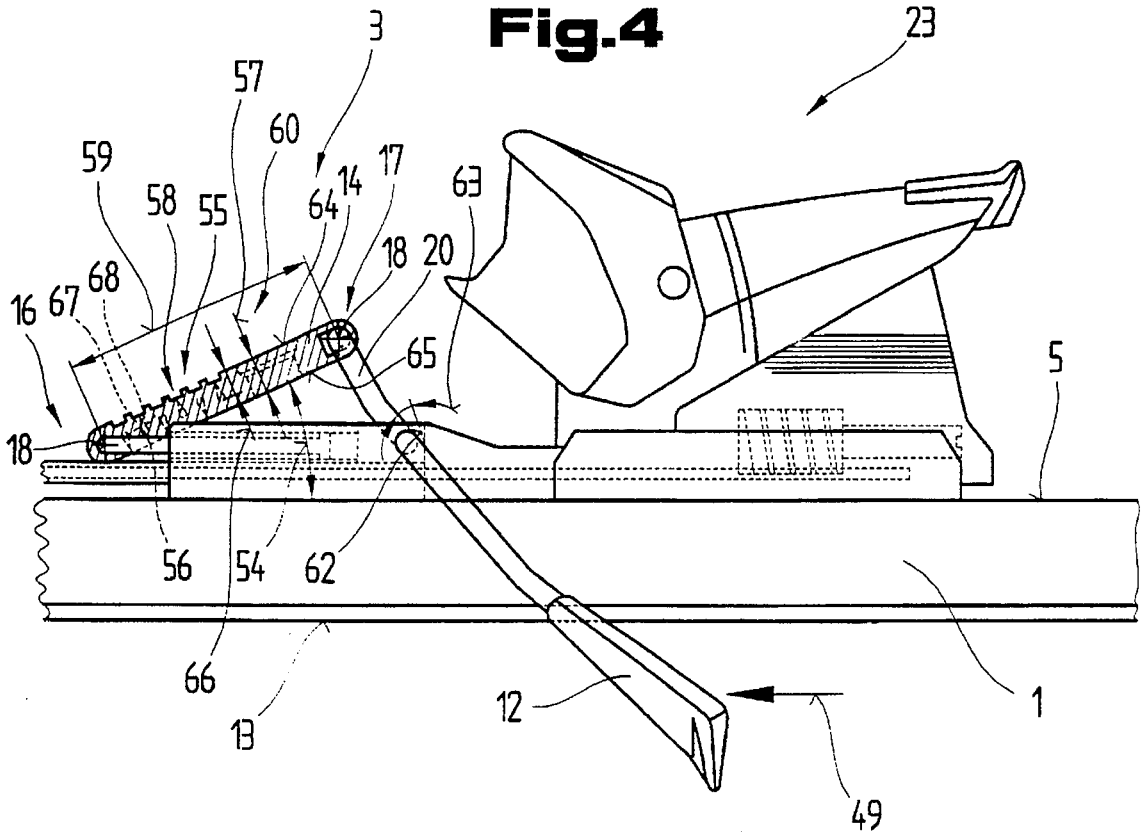
FIG. 4 is a side view, partly in section, of another embodiment of the brake gear in accordance with the invention.
Figure 5:
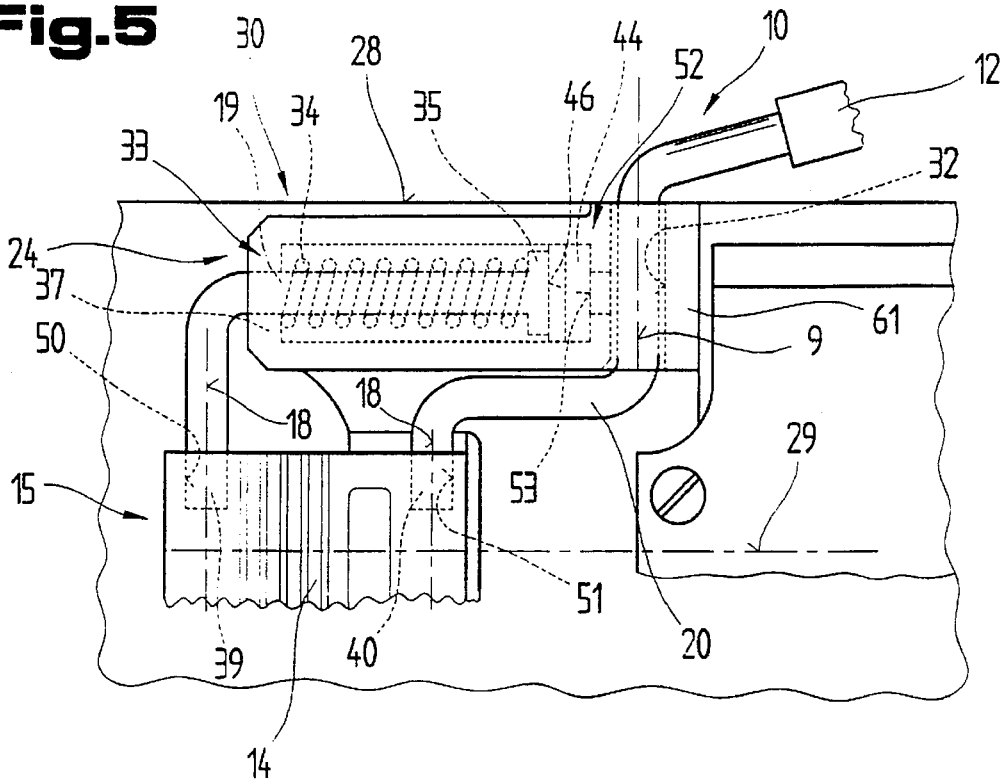
FIG. 5 is a top view of the brake gear according to FIG. 4.

FIGS. 4 and 5 show another embodiment of the brake gear 3. In the following description, the same reference numbers are used for components which were described in the previous figures. As already described in the above figures, only one side is considered since the brake gear is symmetric with respect to the longitudinal central axis 29 of the ski 1. The housing 24 of the brake gear 3 is secured on the surface 5 of the ski 1. The adjusting element 19 with the spiral compression spring 34 is mounted in the receiving chamber 30 arranged along the side face 28 of the ski 1 in an adjustable manner in the longitudinal direction of the ski 1. Furthermore, the receiving chamber 30 has a bore 32 in which the brake lever 10 is pivotal about an axis 9.

The adjusting element 19 and the crank arm 20 of the brake lever 10 have pivot pins 39, 40 which extend perpendicularly to the direction of the longitudinal central axis 29 and which engage in sockets 50, 51 of the foot pedal 14, with the result that the bearing arrangements 16, 17 having pivot axes 18 are created.

In the braking position of the brake arm 12, in which the latter extends beyond the running surface 13 of the ski 1, the adjusting element 19 is kept in a retracted position in the receiving chamber 30 by the effect of the spiral compression spring 34. The brake lever 10 is pivoted into the braking position by foot pedal 14 by means of the crank arm 20. A limit stop 52 is provided between the adjusting element 19 and the front wall 37 of the receiving chamber 30, and the abutment element 44 rests against the flange 35 and the base 53. In this braking position of the brake lever 10, the foot pedal 14 which acts as a thrust crank 15 is inclined with respect to the surface 5 of the ski 1 in the direction of the heel clamp 23, angle 54 between the surface 5 and the foot pedal 14 being between 20° and 45°, preferably 30°.

In order to avoid a rigid coupling in the transmission path between the adjusting element 19 and the brake arm 12, the foot pedal 14 has an expansion area 55 in the region between the bearing arrangements 16, 17. This area is formed by slot-shaped depressions 56 in the foot pedal running transversely to the longitudinal extension of the ski, which are spaced apart from one another. Depressions 56, which run in the direction of a thickness 57 of the foot pedal 14, create weakened sections 58 which, when tensile stresses occur in the foot pedal 14 in the direction of the longitudinal extension of the ski 1, allow for an elongation of the distance 59 between the bearing arrangements 16, 17, due to the elastic deformability of the material and the weakened sections 58.

This embodiment of the foot pedal 14 makes it into a damping device 60 which elastically absorbs impact stresses acting upon the brake arm 12 in the direction of arrow 49 when the ski 1 with brake arm 12 collides with an obstacle as it runs in a direction opposite to arrow 49. This reliably prevents damage to the brake gear 3, in particular in the housing 24 where the brake lever 10 passes into the housing. In order to avoid an excessive pivoting causing excessive stresses of the foot pedal 14, the housing 24 has an extension 61 which extends beyond the crank arm 20 in the direction of the heel clamp 23, which forms abutment 62, i.e. a limit stop for the crank arm 20, whereby the maximal adjustment path for the damping and consequently the expansion path of the foot pedal 14 is clearly limited. An angle 63 between the crank arm 20 in its braking position and the abutment 62 is approximately 5°.

The slot-shaped depressions 56 preferably extend alternately from an upper side 64 and underside 65 of the foot pedal 14 in the direction of the thickness 57 to avoid a one-sided deformation of the foot pedal 14. A depth 66 of the depressions 56 is preferably about ⅔ of the thickness 57, the thickness 57 being between 8 mm and 12 mm, preferably approximately 10 mm.

In order to prevent any elastic deformation of the foot pedal 14 with respect to pressure forces, which occur when the brake lever 10 moves out into the braking position for the transmission of braking forces, opposite side faces 67, 68 of the depressions 56 are arranged next to each other in the upper side 64 and the underside 65.

The damping property of the foot pedal 14 serving as a damping device 60 can be varied by the shape of the depressions 56, the selection of the depth 66 with respect to the thickness 57, and also by using materials with different elasticity modules.

Figure 6:
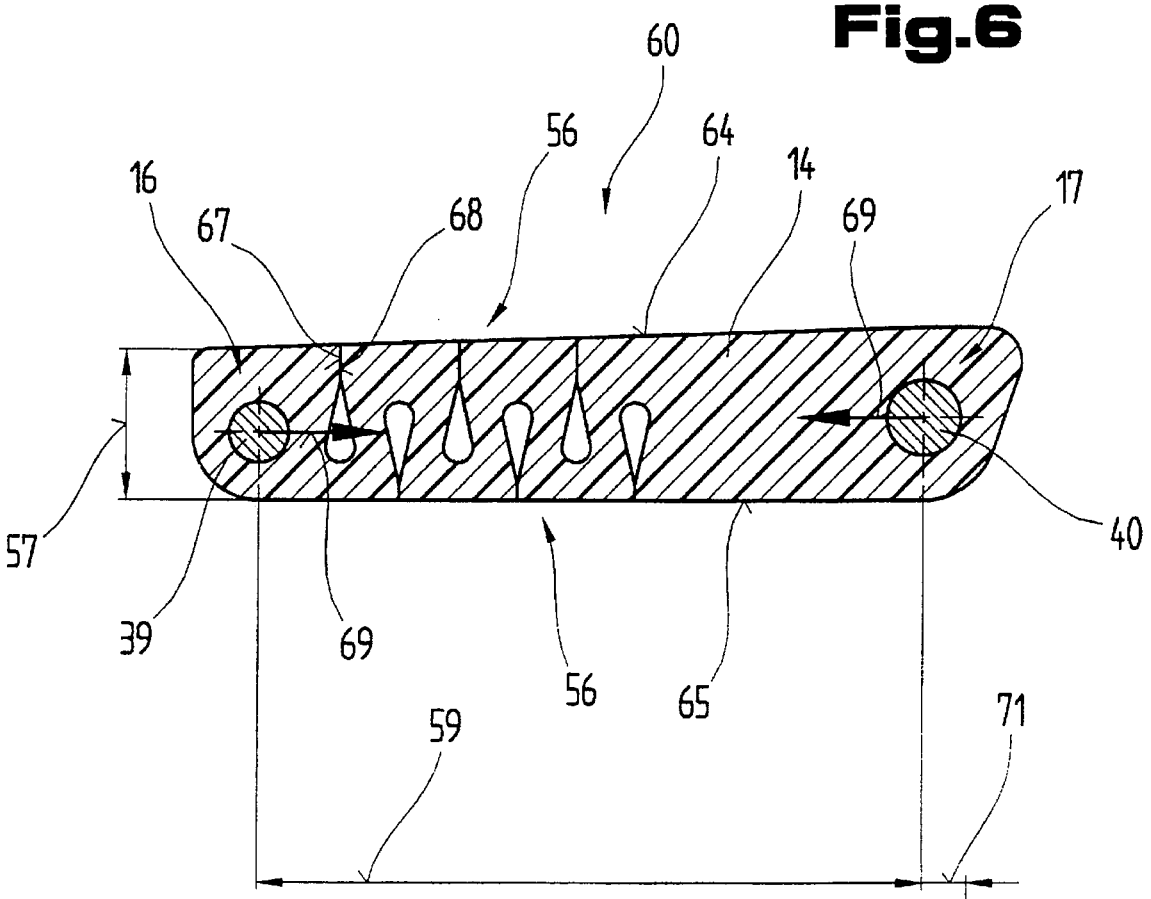
FIG. 6 is a side view, in section, of a foot pedal of the damping device in accordance with the invention according to FIGS. 4 and 5, which is provided with an expansion area.
Figure 7:
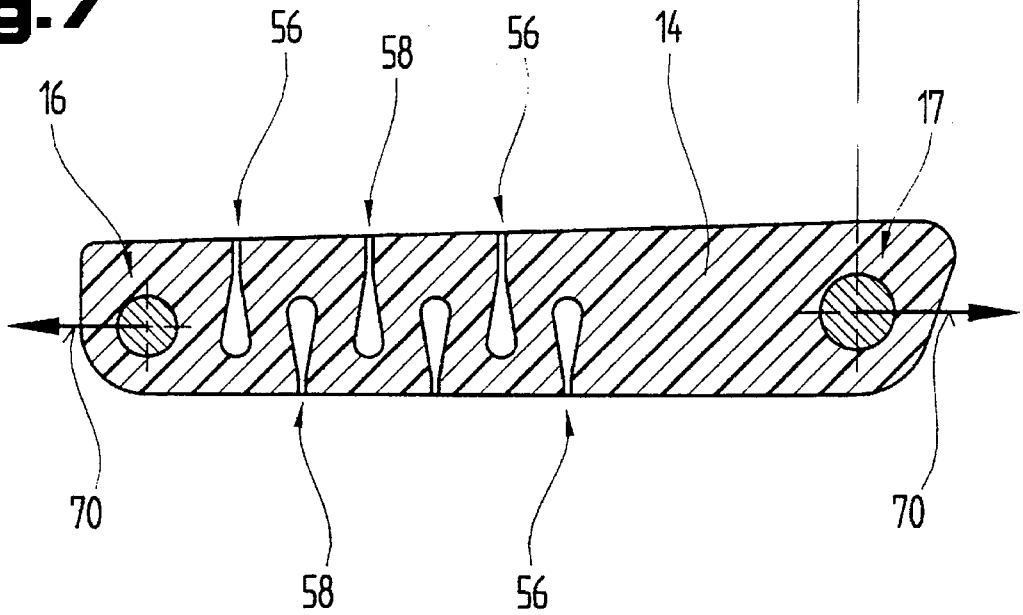
FIG. 7 is a like view of the foot pedal according to FIG. 6 when tensile forces occur.

FIGS. 6 and 7 show in detail the embodiment of the damping device 60 which is constituted by the foot pedal 14. Between the bearing arrangements 16, 17 for the pivot pins 39, 40, pedal 14 has slot-shaped depressions 56, which are spaced apart from one another and extend towards each other alternately from the upper side 64 and underside 65 over a portion of the thickness 57.

If the foot pedal, as shown in FIGS. 6 and 7, is stressed by pressure forces according to arrows 69 against the pivoting direction of the brake levers 10, as it takes place in the braking position, the side faces 67, 68 of the depressions 56 are at least adjacent to the upper side 64 and the underside 65 close together. This way, the force can be transmitted effectively without reducing the brake pressure and the transmission of the actuating force to bring in the brake arms 12 into the position of readiness or rest is reliably ensured. A possible damping of the brake effect occurs by means of the deformation of the energy storage device, for example the spiral compression spring 34.

In case that tensile stresses act upon the foot pedal 14 in the region between the bearing arrangements 16, 17 in the direction of arrows 70, as apparent from FIG. 7, for example when stresses occur in the pivoting direction, there is a spring-back due to the elasticity of the material of the foot pedal 14 in the region of the depressions 56 and thus also an elastic elongation of the distance 59 by a spring path 71. As soon as the tensile forces are eliminated, the elastic readjusting property of the material causes a return to original distance 59 between the bearing arrangements 16, 17 whereby the brake levers 10 are also returned into the initial position.

The slot-shaped depressions 56 are rounded at their base to avoid breaks which would occur if they had sharp edges. This assures a long life span of the foot pedal 14 even when the foot pedal is elastically deformed several times in the weakened section 58. Moreover, if the elasticity of the material remains about the same over a large range of temperature, of approximately between −30° C. and +30° C., the danger of a break of the foot pedal 14 is effectively avoided, even when tensile stresses occur under changing temperature conditions.

Figure 8:
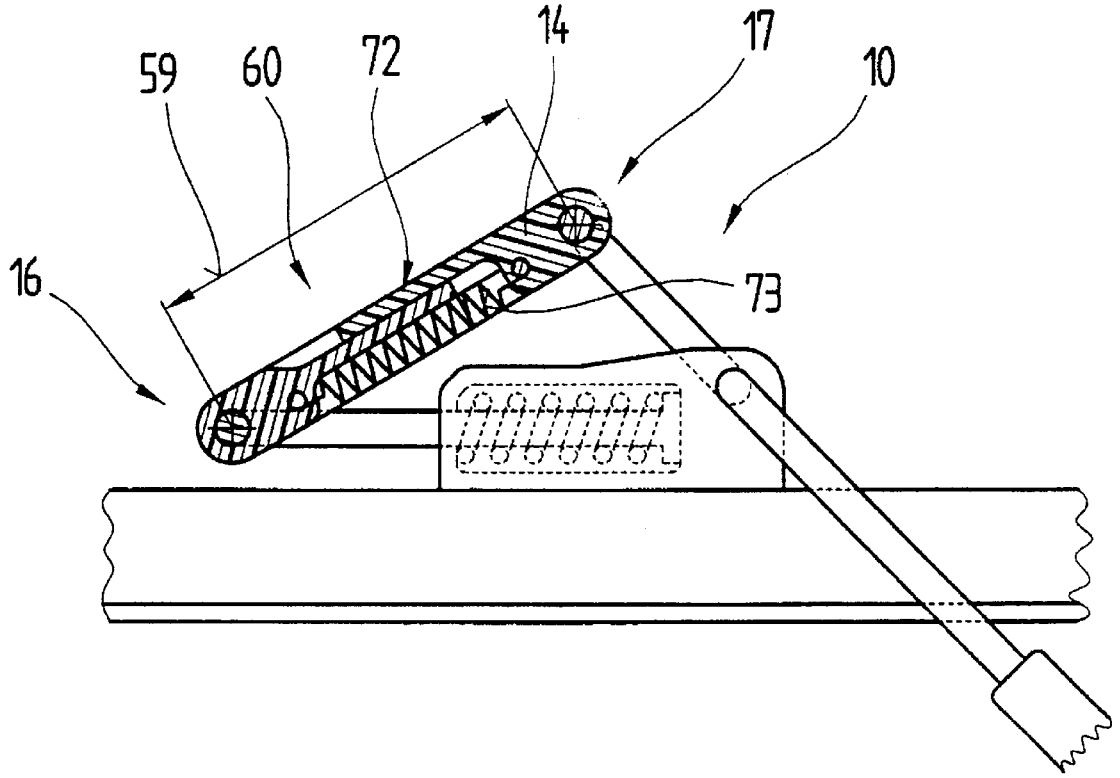
FIG. 8 is a side view, partly in section, of a further embodiment of the brake gear in accordance with the invention.

FIG. 8 shows another embodiment of a foot pedal 14 which is constructed as a damping device 60. This foot pedal has two parts between the bearing arrangements 16, 17, the parts which face each other in a guided arrangement 72 being adjustable with respect to the distance 59 between the bearing arrangements 16, 17. A tension spring 73 or compression spring which is biased between the bearing arrangements 16, 17 against corresponding complementary stops holds the two-part foot pedal 14 at the appropriate distance 59 between the bearing arrangements 16, 17. If a force is now exerted on the brake lever 10 in the direction of movement into the braking position, the tension spring 73 springs back and a relative movement in the two-part foot pedal 14 in the region of the guided arrangement 72 takes place, which achieves a dampened absorption of such impact stresses which act upon the mechanism.

Figure 9:
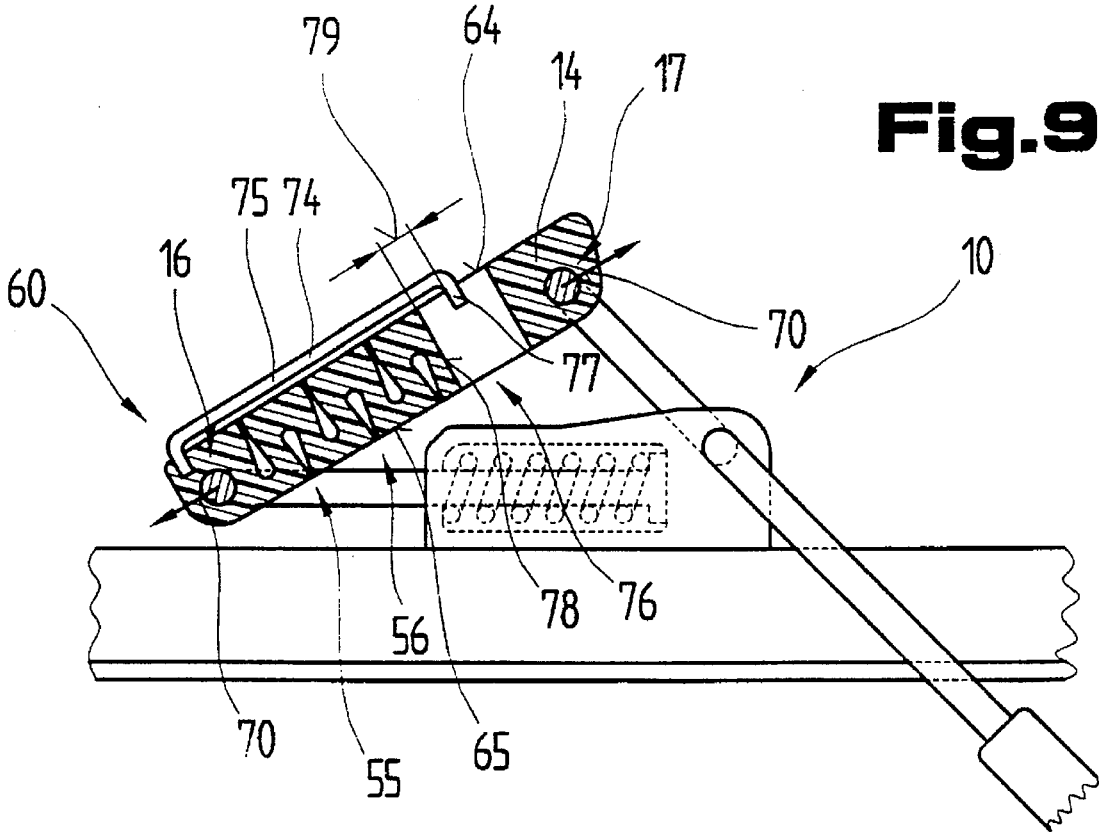
FIG. 9 is a side view, partly in section, of yet another embodiment of a foot pedal of the brake gear in accordance with the invention, which is provided with a damping device.

FIG. 9 shows another embodiment of the foot pedal 14 with expansion area 55 formed by the depressions 56. Here, a limit of the adjustment path of the expansion area 55 is constituted by an abutment element 74, which in the region of the bearing arrangement 16 is connected immovably with the foot pedal 14, and which comprises a shank 75 extending along the expansion area 55 and running along the upper side 64 or underside 65, and a further shank 77 which extends approximately perpendicularly thereto into a recess 76 of the foot pedal 14. Between a side face 78 of the recess 76 closer to bearing arrangement 16 and the shank 77, a distance 79 is provided, which corresponds to the adjustment path for the expansion area 55. This makes it possible to maintain a defined adjustment between the bearing arrangements 16, 17 when tensile forces occur in the direction of arrows 70 and also to ensure the end position of the brake lever 10 even when there is a stress in the direction of movement of the ski and in the direction opposite the braking effect, and on the other hand, excessive stress and thereby a break of the foot pedal 14 is prevented.

Figure 10:
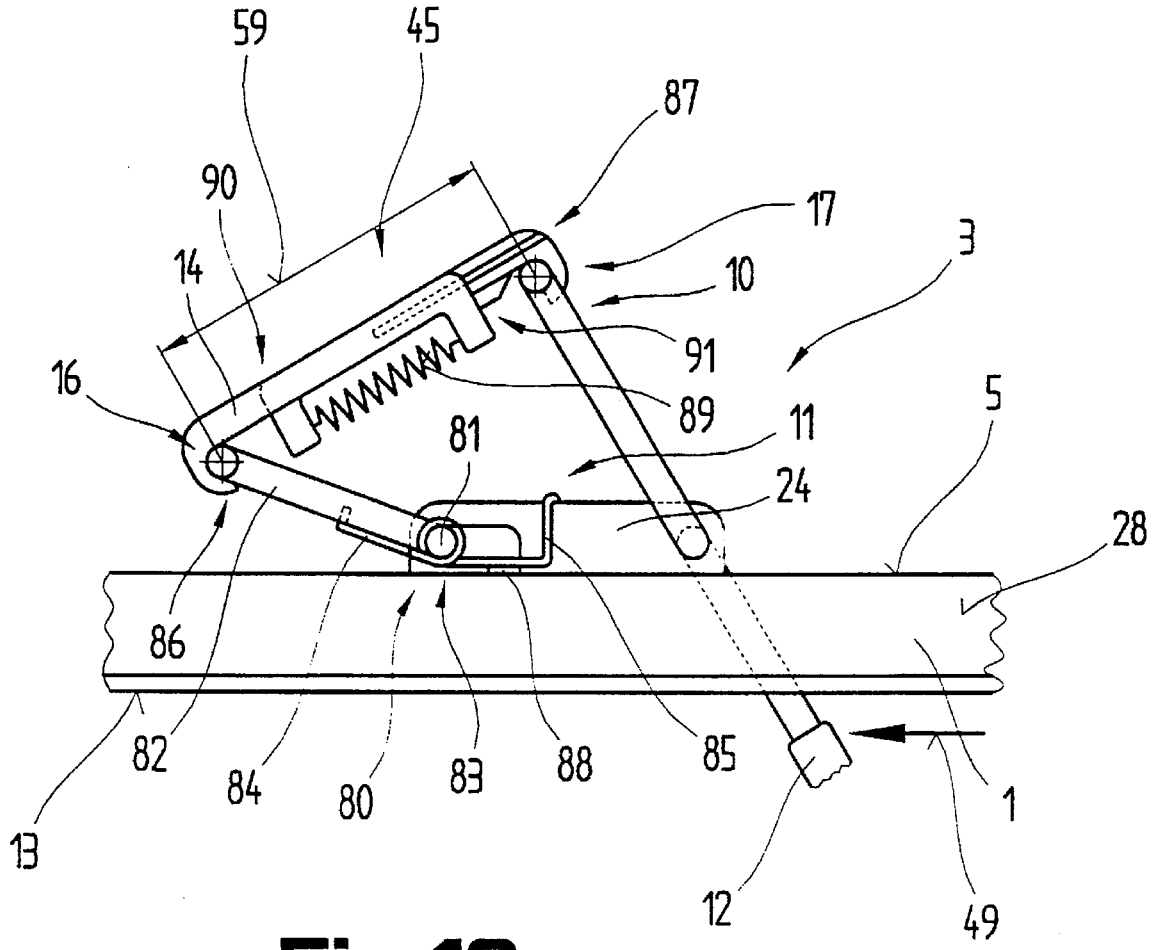
FIG. 10 is a side view of still a further embodiment of the foot pedal of the brake gear in accordance with the invention, which is provided with a damping device.

FIG. 10 shows a further embodiment of the brake gear 3, with the foot pedal 14 constituting the damping device 45 in accordance with the invention. The housing 24, which accommodates the brake lever 10, is secured on the ski 1. Moreover, the housing 24 has a bearing 80 for a pivot pin 81 of a crank arm 82, which can be pivoted about the pivot pin 81 in a plane running in the longitudinal direction of the ski and perpendicular to the surface 5. Spring 83, which with one shank 84 bears on the crank arm 82 and with a further shank 85 bears on the housing 24 and the surface 5 of the ski 1, biases the unstressed foot pedal 14 away from the surface 5. At an end 86 opposite pivot pin 81, the crank arm 82 is connected in a pivotal manner with the foot pedal 14 in the bearing arrangement 16. In the present embodiment, the foot pedal 14 is comprised of two parts between the bearing arrangement 16 and the further bearing arrangement 17 for the brake lever 10, the parts being guided in a longitudinal guiding arrangement 87 in a displaceable manner relative to one another.

When spring 83 moves the crank arm 82 from a ready-position, in which the latter extends along the surface 5, into the pivotal position, brake lever 10, which is linked to the crank arm 82 by the foot pedal 14, is pivoted. This way, the brake lever 10 is moved into the braking position in which said lever extends beyond the running surface 13 of the ski 1. A limit stop is provided by an abutment 88 which is secured on the crank arm 82, which bears on the surface 5 of the ski 1 in a pivoted position of the crank arm 82.

In this embodiment, the damping device 45 has a spiral compression spring 89 between the two parts of the foot pedal, which are displaceable with respect to one another in the longitudinal guiding arrangement 87 of the foot pedal 14.

If a force in the direction of arrow 49 is exerted on the brake arm 12 of the brake lever 10 in the direction of the pivoting movement, a dampening absorption of this force is made possible by displacing the parts of the foot pedal 14 in a direction against the spring force of the spiral compression spring 89. This makes it possible to absorb such impact stresses. After easing off of the sudden increase of load, the former distance 59 is reinstated by abutment arrangements 90, 91 between the parts of the foot pedal 14 and the bearing arrangements 16, 17 by the effect of the spring force of the spiral compression spring 89.

This embodiment makes it possible to use the damping device 45 with a brake gear 3 which is actuated by a crank arm 82 which is arranged about centrally between the side faces 28 of the ski 1.

In this embodiment and also in the above described embodiments of the damping device 45, the damping force, for example of the abutment element 44, the tension spring 73, the spiral compression spring 89 or the deformation force, is determined by the elastic properties of the material of the foot pedal 14 as a function of the values defined by the appropriate standards for the minimal value which has been set for the braking effect of the brake arm 12. The force at which the damping device 45 is actuated lies in any case above the value set for the braking force. Thus, it is ensured that the set braking force is applied also at a movement of the ski 1 against the direction of forward movement, and that the effect of the damping device 45 takes only place when this force is exceeded, i.e. at a sudden increase of load when the brake lever 10 collides with an obstacle, so that a breaking of the transmission elements or the housing 24 is prevented.

Of course, this embodiment also includes an arrangement of a pair of crank arms 82 which produces a better lateral stability of the foot pedal 14.

Furthermore, it should be noted that for clarity of the representation, some components have been illustrated out of proportion to others.

Merely for the sake of completeness, it has to be mentioned that combinations of features recited in dependent claims may form their own inventive solutions independently of the combinations recited in the independent claims.

In particular, each individual embodiment shown in the drawing may be the object of an invention.

What is claimed is:

1. A brake gear for an elongated sports apparatus having an upper surface, a running surface and a central axis extending in a longitudinal direction, which comprises (a) a bearing device arranged symmetrically with respect to the central axis, the bearing device comprising (1) a housing mounted on the upper surface on each side of the central axis, the housing defining a first bore extending parallel to the upper surface and the central axis, and a bearing bore extending parallel to the upper surface and perpendicularly to the central axis, (b) a brake lever having a portion rotatably mounted in the bearing bore, a crank arm extending from one end of the brake lever portion above the upper surface and a brake arm extending from an opposite end of the brake lever portion at an angle thereto, rotation of the brake lever portion in the bearing bore causing the brake arm to be pivoted from a rest position above the upper surface to a braking position therebelow, (c) a spring force storage device arranged in the first bore for applying an adjusting force to the brake lever to pivot the brake arm into the braking position, (d) an adjustment element having a portion extending into the first bore and having a flange at an end thereof, the spring force storage device being arranged between the flange and an end wall of the housing, and a pivot pin extending outside the housing perpendicularly to, and towards, the central axis, (e) a foot pedal arranged between the adjustment element and the crank arm for transmitting the adjusting force, and (f) a damping device arranged between the flange and an abutment of the housing opposite the end wall, the damping device exerting a damping force in a direction opposite to the adjusting force of the spring force storage device and having a length which is variable along an adjustment path from a rest position in the direction of the damping force, the minimal damping force in the rest position being at least equal to the adjusting force in the braking position of the brake arm.

2. The brake gear of claim 1, wherein the damping force increases linearly along the adjustment path.

3. The brake gear of claim 1, wherein the damping force increases exponentially along the adjustment path.

4. The brake gear of claim 1, wherein the damping device is comprised of an elastic, non-resilient plastic material.

5. The brake gear of claim 1, wherein the damping device is comprised of an elastically restorable plastic or rubber having a deformation force which is higher in the damping force direction than in the adjusting force direction.

6. The brake gear of claim 1, wherein the damping device has a deformation resistance which is less under tensile stress than under pressure.

7. A brake gear for an elongated sports apparatus having an upper surface, a running surface and a central axis extending in a longitudinal direction, which comprises (a) a bearing device arranged symmetrically with respect to the central axis, the bearing device comprising (1) a housing mounted on the upper surface on each side of the central axis, the housing defining a first bore extending parallel to the upper surface and the central axis, and a bearing bore extending parallel to the upper surface and perpendicularly to the central axis, (b) a brake lever having a portion rotatably mounted in the bearing bore, a crank arm extending from one end of the brake lever portion above the upper surface and a brake arm extending from an opposite end of the brake lever portion at an angle thereto, rotation of the brake lever portion in the bearing bore causing the brake arm to be pivoted from a rest position above the upper surface to a braking position therebelow, (c) a spring force storage device arranged in the first bore for applying an adjusting force to the brake lever to pivot the brake arm into the braking position, (d) an adjustment element having a portion extending into the first bore and having a flange at an end thereof, the spring force storage device being arranged between the flange and an end wall of the housing, and a pivot pin extending outside the housing perpendicularly to, and towards, the central axis, (e) a foot pedal arranged between the adjustment element and the crank arm for transmitting the adjusting force, the foot pedal being constructed as a damping device and exerting a damping force in a direction opposite to the adjusting force of the spring force storage device and having a length which is variable along an adjustment path from a rest position in the direction of the damping force, the minimal damping force in the rest position being at least equal to the adjusting force in the braking position of the brake arm, and (f) an abutment element in the first bore for holding the adjustment element in position in the first bore when the adjusting force of the spring force storage device is partially relaxed in the braking position.

8. The brake gear of claim 7, wherein the damping force increases linearly along the adjustment path.

9. The brake gear of claim 7, wherein the damping force increases exponentially along the adjustment path.

10. The brake gear of claim 7, wherein the foot pedal is comprised of an elastic, non-resilient plastic material.

11. The brake gear of claim 7, wherein the foot pedal is comprised of an elastically restorable plastic or rubber having a deformation force which is higher in the damping force direction than in the adjusting force direction.

12. The brake gear of claim 7, wherein the foot pedal has a deformation resistance which is less under tensile stress than under pressure.

13. The brake gear of claim 7, further comprising a stationary abutment for limiting the adjustment path of the foot pedal.

14. The brake gear of claim 7, wherein the foot pedal is comprised of two telescoping parts, and a damping element interconnects the two foot pedal parts.

15. The brake gear of claim 7, further comprising bearing arrangements linking respective ends of the foot pedal to the adjustment element and the brake lever, respectively, the foot pedal defining an elongation area between the bearing arrangements.

16. The brake gear of claim 15, wherein the elongation area has spaced apart weakened sections extending transversely to the damping force.

17. The brake gear of claim 16, wherein the weakened sections are defined by alternating slots extending towards each other from an upper side and an underside of the foot pedal.

18. The brake gear of claim 17, wherein the slots have a depth corresponding approximately to two thirds of the thickness of the foot pedal.

19. The brake gear of claim 17, wherein the slots have side faces which are adjacent each other at the upper side and the underside.

20. The brake gear of claim 7, further comprising a stop on the housing for limiting the movement of the crank arm.

21. The brake gear of claim 20, wherein the stop and the crank arm enclose an angle of approximately 5° in the braking position.

* * * * *